United States Patent [19]

Brunner

[11] Patent Number: 5,031,534

[45] Date of Patent: Jul. 16, 1991

[54] METHOD AND APPARATUS FOR SETTING UP FOR A GIVEN PRINT SPECIFICATION DEFINED BY A BINARY VALUE REPRESENTING SOLID COLOR DENSITY AND DOT GAIN IN AN AUTOTYPE PRINTING RUN

[76] Inventor: Felix Brunner, CH-6611 Corippo, Switzerland

[21] Appl. No.: 398,240

[22] Filed: Aug. 23, 1989

[30] Foreign Application Priority Data

Sep. 5, 1988 [DE] Fed. Rep. of Germany ..... 3830121

[51] Int. Cl.[5] ..... B41F 31/02

[52] U.S. Cl. ..... 101/365; 101/350

[58] Field of Search ..... 101/365, 350, DIG. 45, 101/DIG. 47, 183

[56] References Cited

U.S. PATENT DOCUMENTS 3,930,447 1/1976 Murray ..... 101/365

4,852,485 8/1989 Brunner ..... 101/365

*Primary Examiner*—Edgar S. Burr

*Assistant Examiner*—C. A. Bennett

*Attorney, Agent, or Firm*—Michael J. Striker

[57] ABSTRACT

The invention relates to a method and an apparatus for setting up a print specification defined by a binary value representing the solid color density and the dot gain on an autotypically operating polychrome printing machine. Binary values representing solid color density and dot gain measured by means of a densitometer are tested for their conformity with the print specification with the aid of correlations between solid color densities and dot gains from previous, similar printings, in order to determine at the earliest possible time during the setting up of the printing press for a new print order whether the print specification can be achieved by the mere manipulation of its color area adjusters. If conformity can not be achieved, the printing press is shut down. By varying relevant printing parameters an alteration of the momentary relationship existing between the solid color density and dot gain is brought about such that, when the printing is resumed, conformity with the print specification may be achieved. If necessary these steps are repeated several times.

14 Claims, 3 Drawing Sheets

METHOD AND APPARATUS FOR SETTING UP FOR A GIVEN PRINT SPECIFICATION DEFINED BY A BINARY VALUE REPRESENTING SOLID COLOR DENSITY AND DOT GAIN IN AN AUTOTYPE PRINTING RUN

BACKGROUND OF THE INVENTION

The invention relates to a method for establishing a given print specification defined by a solid color density/dot gain binary value in an autotype printing run which can be influenced by a plurality of printing parameters, on an autotypically operating polychrome printing press with controllable adjusters for influencing one of these printing parameters, namely the feeding of printing inks to adjacent color zones of a material being imprinted in which, for at least one printing ink, solid color densities and dot gain are repeatedly determined by densitometer on patches simultaneously printed within the color zones and the adjusters are regulated accordingly.

The invention further relates to an apparatus on an autotypically operating polychrome printing press with a color density measuring system having at least one densitometer, for the determination of solid color densities and dot gain when the printing press is set up, by the densitometric measurement of simultaneously printed solid patches and screen patches, and with a computer.

Numerous processes and apparatus have been proposed in recent years for the achievement of a uniform printing result (EP No. 0196431, U.S. Pat. No. 3,835,777, GB No. 2,000,082, EP No. 0095649). They serve essentially to permit or to simplify the maintenance of the color balance or at least of preselected color densities in the different color areas, the term "color density" being able to be understood both as a solid color density and as a screen density, i.e., a density value measured on a screen measuring patch.

In addition to the application of such methods and apparatus the need often exists for preparing the printing result also to provide for a given print specification which is defined for each printing color involved, e.g., black, cyan, magenta and yellow, each being defined by a binary number representing the solid color density and the dot gain or screen dot variation. The chief reason for this is to be seen in the fact that identity between proofs on the one hand, which are usually prepared by reproduction houses, and print runs on the other hand, which normally are produced by printing plants, can be achieved only when the above-mentioned binary values are identical in both products. This requirement is, as a rule, not fulfilled and scarcely possible of fulfillment, at least when a relatively great number of companies are involved in producing the printing, as is the case, for example, with the production of periodicals with a great number of color advertisements. In such cases the printing plants and reproduction houses are therefore involved in an agreement on a print specification under which all the participating firms operate in order to assure identity between the proof and the printing run.

Most widespread in this connection for offset printing presses is the "Eurostandard Offset" for the so-called "Commercial Offset Printing" on high-quality, coated papers, and the "Eurostandard Publication" for the printing of periodicals.

The following binary values are used for the "Eurostandard Offset."

| | Solid Color Densities | Screen Dot Enlargement (Dot Gain) |
|---|---|---|
| Black | DV = 1.50 | PV = 17% |
| Cyan | DV = 1.30 | PV = 15% |
| Magenta | DV = 1.40 | PV = 15% |
| Yellow | DV = 1.30 | PV = 15% |

Printing according to such a print specification constitutes one of the most difficult problems in working with offset printing presses. The operator of the machine must for this purpose first attempt, during the setting up of the press, to change the one easily influenced printing parameter, namely the feeding of the inks to the individual color areas, by controlling the adjusters (ink valves, area screws, or the like) so that in each individual color area the one or the other of the solid color density/dot gain binary values comes substantially close to the corresponding specification. This is indeed possible in most cases, but it involves some effort, since after each change he makes in an adjuster, the operator must wait for several hundred impressions until the new ink feed has stabilized. When the value corresponding to the specification is finally reached, this does not necessarily mean that the other value of the binary will correspond to its associated standard. Instead the opposite is often found, namely that after the set-up phase described only one of the two values of the binary agrees with the associated specification, while the other value differs unacceptably from its specification and therefore in the end no conformity with the print specification has been obtained.

The operator must therefore now interrupt the printing and attempt, by altering at least one other printing parameter, to adjust the two values of the binary independently of one another in such a degree and direction that finally the desired print standard can be achieved. This is the case with any particular printing order. For even in the case of print orders which are very similar as regards printing plate, paper and printing inks or are even identical and are performed on the same printing press, entirely different dot gains can become established at any selected value of the solid color density. This is dependent upon numerous print parameters, e.g., temperature and atmospheric humidity, the viscosity and/or tack of the printing inks, the different properties of the papers and inks used, in spite of identical quality specifications or the like.

Any change made in this manner in any other printing parameter, i.e., one not relating to the feeding of ink to the color areas is, as a general rule, bound up with the necessity of running again, one or more times, through the above-described process steps for every printing ink and color area involved, until at last the achievement of the print specification is assured. Any abbreviation of this complicated and difficult procedure has not been possible to date, since it cannot be predicted with any assurance what conditions will be when some printing order is performed on the printing press or whether on the basis of this adjustment the stipulated specification on which the test print is based can be obtained at all merely by manipulating the adjusters. Consequently, the procedure described, which involves costly investments in machine time and paper, must either be accepted, or a decision must be made in cooperation with the client in an early phase during the setting up of the printing press, as to whether the print order is to be executed by departing from the print specification agreed upon.

The above-explained, known methods and apparatus can contribute nothing to the solution of the problem described, since they are aimed at the achievement of a uniform print result, and in doing so attempt either to keep given magnitudes constant or to provide recommendations leading to the result best achievable under the given circumstances, but one which does not need to correspond to the given print specification.

The invention is addressed to the problem of further developing the methods and apparatus referred to above to the effect that the operator will be able at a comparatively early moment of time, during the setting up of the printing press, to determine whether the stipulated print specification can be achieved by the mere manipulation of the adjusters, under the circumstances found at the beginning of the execution of a print order.

According to this invention, the method mentioned above is characterized in that at the beginning of the set-up, at least one solid color density/dot gain binary value is tested for conformity with the print specification under consideration of correlations between solid density and dot gain, that the printing run is interrupted if the conformity moves away from a preset tolerance range, that at least one printing parameter other than the one affecting ink feed is changed so as to alter the current "solid color density, dot gain" function, that then the printing run is resumed, and that thereafter, each of these steps is repeated as often as needed until the conformity lies at least in the preselected tolerance range.

The apparatus mentioned above is characterized in accordance with the present invention in that the color density measuring system and the computer are configured and interconnected as parts of a test apparatus intended for testing the printing press for its conformity with a given print specification.

The invention offers two important advantages. On the one hand, it is possible to calculate in advance, by using the correlations known from previous print orders, with the aid of a number of binary values which do not have to be identical to the corresponding specification either in regard to the solid color density or in regard to the dot gain, whether a fairly close approach to the given print specification can be achieved simply by varying the adjusters. Therefore even at a very early time during the set-up phase it can be decided whether the previously calculated departures from the print specification are tolerable or whether the printing process must be interrupted and the achievement of the print specification must be assured by other controllable print parameters. On the other hand, it is not necessary at the beginning of the print to find the specific correlation in the execution of the print order by varying the adjusters. This saves the creation of a great deal of waste paper and the loss of expensive machine time in taking readings which are not at all necessary for judging conformity.

Additional advantageous features of the invention will be found in the following description of a most prefered embodiment of this invention.

The invention will be further explained below with the aid of an embodiment in conjunction with the appended drawing, wherein.

Figure 1:
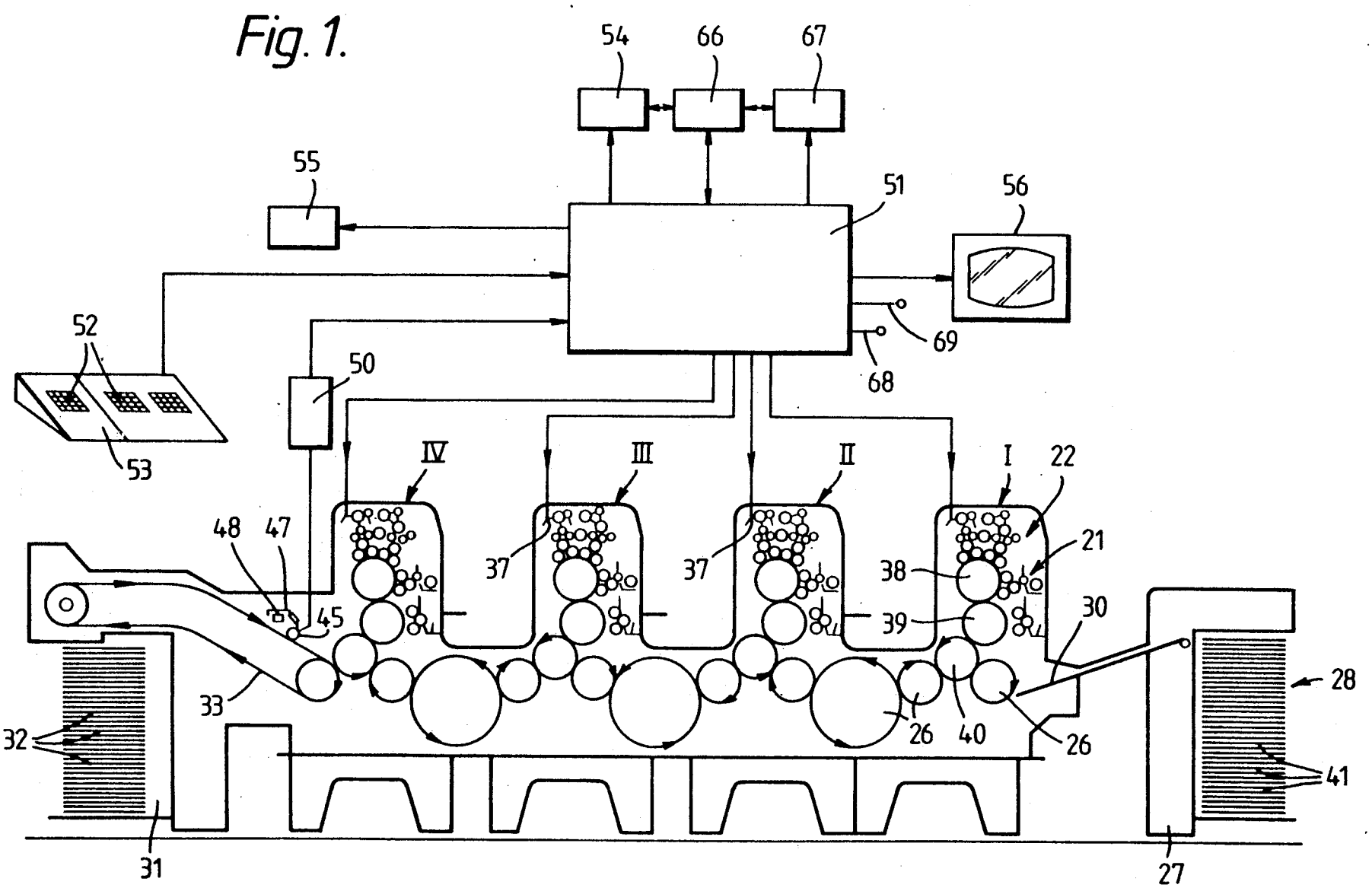
FIG. 1 is a diagrammatic side view of a four-color offset printing press.
Figure 2:
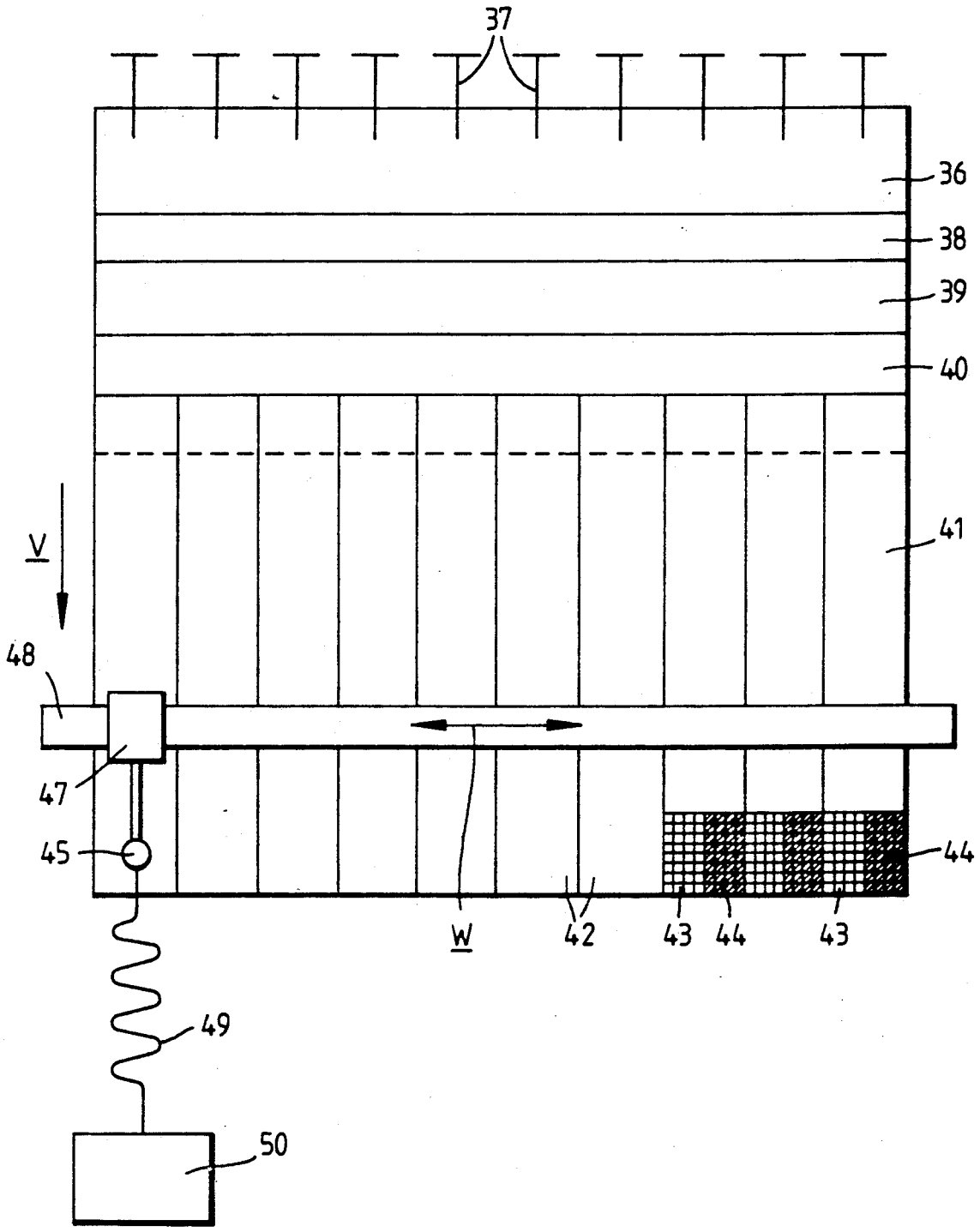
FIG. 2 is a diagrammatic plan view of a color bank of the offset printing press of FIG. 1.

FIGS. 1 and 2 show the diagram of an autotypically operating four-color offset printing press with four color banks I to IV, color bank I being associated for example, with the color black, while color banks II to IV, for example, print the colors cyan, magenta and yellow. Each color bank includes a moistener 21, an inker 22, a platen 38 around which a printing plate consisting of aluminum and bearing the picture to be printed is tightly drawn, a rubber blanket roll 39 and a printing cylinder 40. A set of transfer rolls 26 is provided one in front and one in back of each printing cylinder 40. The offset printing press furthermore has at its entrance a magazine 27 for a stack 28 of individual unprinted sheets 41 of a printing material such as paper, and a table 30, while a magazine 31 for printed sheets 32 is provided at its output end.

The purpose of the inker 22 is to continually supply the platen with the necessary amount of ink. For this purpose it has an ink box 36 which serves as a reservoir for the printing ink, and on which a plurality of adjusters 37 are provided in the form of zone screws or the like which control the flow of the printing ink from the ink box 36 such that the flow of ink can be individually adjusted zone-wise over the entire printing width. The printing ink is lastly picked up by the inking rolls which are in contact with the platen and coat it with a thin ink film.

From the inked areas of the printing plate the ink is first transferred to the rubber blanket cylinder which is in contact under light pressure with the platen 38 and from there it is transferred to the sheet 41 of the material being printed. From the plan view in FIG. 2 of a single color bank, of which only the ink box 36 with the adjusters also indicated in FIG. 1 is diagrammatically indicated, it can be seen that the ink box 36, the platen 38, the rubber blanket roll 39 and the printing cylinder 40 each extend over the entire printing width of the press. A portion of a printed sheet 41 is still lying on the printing cylinder 40. On the basis of the adjusters 37 the sheet 41 is imprinted in a number of hypothetical, parallel and contiguous color areas 42 corresponding in number to the number of the adjusters, these areas consisting of stripes running in the direction of movement (arrow v) of the sheet 41. On the top and/or bottom margin of sheet 41, test spots in the form of screen areas 43 and solid areas 44 are additionally printed, at least one screen area 43 and one solid area 44 preferably being provided for each color zone 42, although each screen 43 or solid area 44 could also extend over the width of several color zones 42. The screen areas 43 are printed by corresponding sections created in the printing plate, which are present in preselected graduations and consist of dots of equal size having a certain area coverage per unit area of these sections. Corresponding sections are provided on the screen film used in making the printing plate, in which the screen dots have, for example, surface coverages of 25%, 50% and/or 75%. From the enlargement or reduction, i.e., the variation of the dots of the screen areas 43 in relation to the corresponding sections in the screen film and printing plate, it is therefore possible to conclude what effect the amount of ink set by any adjuster produces in printing or what variations are produced with respect to the surface coverage of the screen dots when a change is made in the setting of the corresponding adjuster 37. A dot gain or screen dot enlargement of, for example, 15% would therefore mean that a screen dot in the area corresponding, for example, to the 50% grade, has been increased to a 65% grade dot with respect to the corresponding screen areas of the screen film, the printing plate, or any other system of reference agreed upon. The solid areas 44, however, consist of areas which as a rule are completely covered with printing ink and are formed by corresponding sections in the film or in the printing plate. The solid areas 44, therefore, give information especially as to whether much or little printing ink has been fed by means of an adjuster 37, because only the thickness of the layer of applied printing ink can vary in the solid areas 44.

The screen areas 43 and solid areas 44 are tested by means of known densitometers, preferably reflected light densitometers, for the purpose of achieving objective measurements. These can be manually operated densitometers (e.g., Macbeth RD-918 or RD-1018) or automatically operating densitometers (e.g., Macbeth PXD-981) which are made and sold by Kollmorgen-Macbeth in Newburgh, N.Y. (U.S.A.). If manual densitometers are used, a sheet 29 is taken at predetermined intervals from the stack of printed sheets and tested. If the values obtained from the print are different from those of the original, the printer can attempt, by changing the settings of the adjusters, to bring the measurements back into agreement with those of the original. If an automatic densitometer 45 is used, it is best mounted on a carriage 47 which can be driven back and forth by controllable motors, e.g., stepping motors, on a rail 48 in the direction of the double arrow w across the width of the sheet 41. In accordance with FIG. 1, the rail 48 can be disposed at some point along the path of movement of the sheet 41 between the magazines 27 and 31.

The sections producing the test patches 43 and 44 can be placed on the printing plate such that, after a sheet 41 has been completely printed, the associated test patches of all printing inks are printed one over the other. Alternatively, however, the test patches of the individual printing inks can also be so arranged that, after printing, they lie one beside the other and therefore each printing ink is associated with a separate test patch. The densitometer 45 is best connected by a flexible cable 49 to an automatic electronic processing circuit 50 or the like.

Alternatively, a single sheet taken from the machine can be scanned manually and by means of a densitometer automatically carried across the sheet. The same or a similar procedure can be used in the case of a roller offset printing press.

The densitometer 45 measures the optical density D, i.e., the decadal logarithm of the reciprocal of the reflection, which is the quotient of the reflected light flux and the incident light flux. If the optical density is measured on a test patch 43, the screen density $D_R$ is obtained, while the density measured on a solid surface 44 is referred to as the solid tone density $D_V$. On the basis of $D_R$ and $D_V$ it is possible in a known manner (Murray-Davies, Julye-Nielson) to compute the so-called optically active surface coverage of the screen dots, which is slightly greater than the so-called mechanical surface coverage which is obtained by studying the screen dots with a microscope or the like. For the purposes of the invention, however, it is important that the screen density, just like the optically active or mechanical surface coverage, is ultimately only a magnitude which enables information to be obtained on the size of the screen dots or on their variation with respect to the reference system. In the following description and in the claims, therefore, these terms are generally covered by the term "dot gain".

In the following description, furthermore, the solid color density $D_V$ is given in decimal numbers which usually lie between 1.0 and 1.5, while the dot gain is defined not by the screen density $D_R$ but by the percentage values computed therefrom, with respect to the 50% screen grade in the screen film. A variation, therefore, of 15% means that the screen dots of the 50% grade have become greater by 15% in comparison to the screen film, and now correspond to a screen grade of 65%.

In FIG. 1, a control system 51 is connected with the printing press and is connected to the color density measuring apparatus consisting of densitometer 45 (e.g., Macbeth PXD-981) and processing circuit 50, by means of which the printed sheets are scanned and the data obtained are fed to the control system 51. This system contains, in a known manner, computer and control units which are connected to the adjusters 37 and permit them to be regulated. The control system 51 is moreover connected to a number of peripherals, e.g., to a work station 53 having keyboards 52, a date storage means 54 in the form of a magnetic tape or diskette drive or the like, a printing unit 55, and a monitor 56, e.g. in the form of a video display.

The control system 51 has an output 69 for emitting at least an alarm signal if conformity within the given point specification is lacking.

The operation of the offset printing press described in connection with FIGS. 1 and 2 and of the corresponding control system 51 is generally known from the state of the art set forth above and therefore needs no further explanation (see particularly EP No. 0 196 431, published Oct. 8, 1986, of the same applicant).

In accordance with the invention it is proposed, when setting up a printing press according to FIGS. 1 and 2 to execute a new printing order, to utilize at the earliest possible time the binary values obtained by densitometric scanning of the test patches 43 and 44 to examine the question whether a printing specification can at all be achieved by the mere actuation of the adjusters 37. This is explained below with the aid of an example.

Let us say that the prescribed printing specification is characterized by the binary value 1.3/15%, which corresponds to a solid color density of 1.3 and a dot size enlargement of +15%. It follows from this that the printing press would have to be adjusted during the set-up for the particular printing order being executed such that the solid color densities found on the solid patches 44 assume a value of 1.30 and at the same time the screen densities determined on the screen patches 43 correspond to a dot gain of +15%.

Let it further be assumed that, in an earlier printing order, which was similar as regards the paper, the colors and the printing plate, a correlation of 0.1 at 3% was obtained, i.e., a variation of the solid color density by +0.1, which is brought about by regulating an adjuster 37, had resulted in a dot gain of +3%, or vice-versa a dot gain variation of +3% brought about by operating an adjuster 37, had resulted in a variation of the solid color density by +0.1.

Finally, let it be assumed that, at the beginning of the printing, circumstances accidentally arise which lead to a binary value of 1.2/18%. From this it is apparent first that neither the solid color density nor the dot gain is in accordance with the prescribed specification. But it is not possible to know whether the printing specification might not still be achieved by acting on the adjusters 37.

To avoid the formerly necessary, difficult adjustment phase, the invention furthermore proposes to test the binary value 1.2/18% first measured, with the aid of the correlation (0.1:3%) from the previous, similar printing order, for its conformity with the printing specification. It is then found that a 3% reduction of the dot gain would lead to a reduction of the solid color density to 1.1, or an increase of the solid color density by 0.1 would lead to a dot gain of 21%. These figures show that there is no conformity between the printing press and the printing specification, since if one of the two values of the binary comes closer to the corresponding specification, the other value would depart far from the other corresponding specification. This departure amounts in the case of the solid color density to 0.2 and in the case of dot gain to 6%. It can be concluded from this that the prescribed printing specification cannot be achieved by merely acting on the corresponding adjuster 37.

The described method makes use of two important discoveries, namely that on the one hand the correlation of a given printing press in performing printing operations that are similar but at a different point in time is subject to only comparatively slight differences, even if entirely different solid color density/dot gain binary values are obtained due to the temperature, atmospheric humidity or the like, and that on the other hand the "solid color density, dot gain" function can be varied hardly at all by changing the adjusters 37. If the binary values are plotted, for example, in an X/Y system of coordinates, with the solid color densities along the one axis and the dot gain along the other axis, then all of the binary values thus obtained can be connected together as in FIG. 3 by a curve 58 which represents the "solid color density, dot gain" function in which, for example, the solid color density could be called an independent variable and the dot gain a dependent variable (or vice versa) and whose slope is the correlation. This curve 58 is frequently a straight line in the range herein concerned, with the result that the correlation in this range is constant, although an arcuate shape of curve 58 would produce no change in the principle underlying the invention. The discoveries described above are therefore equivalent to saying that the shape of curve 58 in FIG. 3, and especially its slope, remains largely unaltered in similar printing jobs, even though, as indicated in FIG. 3 by curves 59 and 60, a considerable parallel shift of curve 58 in one or the other direction can occur, resulting, however, only in a change in the function and thus in the absolute values of the solid color density and the dot gain.

Figure 3:
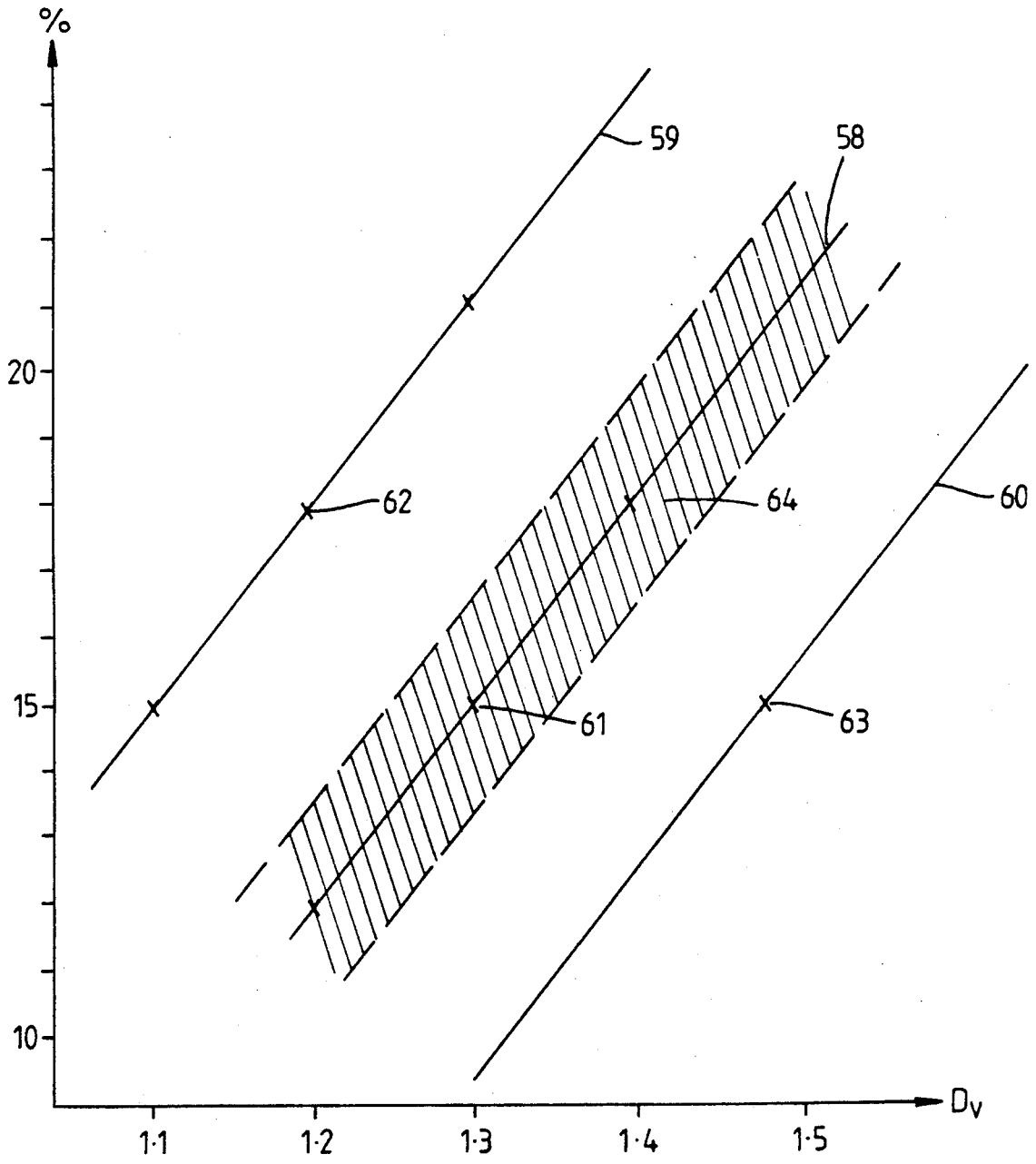
FIG. 3 shows how the color dot gain depends on the solid color density when the setting of an adjuster controlling the ink feed changes.

For the purposes of the invention, it is concluded from this that, when the correlation seen in FIG. 3 exists, a given printing specification of, for example, 1.3/15% (cf. point 61 on curve 58) cannot be brought about by acting on the corresponding adjuster 37 if in setting up the printing press at an earlier time, a binary value of 1.2/18% (cf. point 62 on curve 59) or a binary value of 1.48/15% (cf. point 63 on curve 60) is measured, because the curves 59 and 60 do not contain the binary value 1.3/15%. This is combined, in accordance with the invention, with the requirement that the printing process be interrupted and an attempt made to vary the momentary function or the relationship between the screen dot variation and the full color density by varying one or more printing parameters before the printing process is resumed. In the case of a given printing press, paper quality and printing plate, the viscosity and/or tack of the printing ink offers itself as a variable printing parameter, since both viscosity and/or tack can be easily controlled by means of suitable additives to the printing ink. Also, viscosity and/or tack can lastingly influence the dot gain even if coating thickness or solid color density are held constant.

The operator can now resume the printing, again measure a solid color density/dot gain binary value, and then check whether it is possible, under consideration of the known correlation, to make this new binary value approach 1.3/15% by acting on the corresponding adjuster. If the newly found binary value in the example in FIG. 3 lies on the curve 58, then conformity with the printing specification is achieved. If necessary, the other printing parameters have to be varied several times if, when the printing is resumed, there is still no conformity with the printing specification. At the same time it is, of course, possible first to undertake a slight change in the adjuster 37 in order to confirm by at least one more binary value the impossibility of reaching the print specification. In any case the advantage is obtained that, just on the basis of a very few binary values at which neither of the two values corresponds to the required specification, it can be determined that the print specification cannot be achieved by acting on the adjusters alone.

Other print parameters by means of which a change can be produced in the "solid color density, dot gain" function, may be in addition to the viscosity and/or tack of the printing inks, also a control for shifting and doubling and, if necessary, the elimination of these effects or a change of the printing plate. In the above example, the viscosity and tack of the printing ink could be increased, for instance, or the printing plate could be copied more sharply if it is a positive copy.

Frequently it is unnecessary to achieve strict identity with the stipulated specification. In such a case a tolerance limit other than zero can be associated with one of the two values of the binary. This would mean, for example, that the setting up of a printing press for a stipulated print specification of, for example, 1.3/15% can be continued for as long as the binary value, under consideration of the correlation from a previously performed print run, shows that the solid color density will assume a value of, for example, $1.3 \pm 0.05$ as the screen dot variation approaches 15%. This would lead in FIG. 3 to a strip 64 which contains curve 58 and all binary values which are in conformity with the desired print standard.

An additional example will show this. Let it be assumed that a print standard of 1.20/19% is given with a tolerance of $\pm 0.1$ for the solid color density. From previous setups on similar print runs say a correlation of 0.1 to 4% has been found and, when the press is set up a binary value of 1.25/18% has been measured. In this case an increase of the dot gain by means of the corresponding adjuster 37 to 19% would result in an increase of the solid color density to 1.275. This is within the allowable tolerance of $1.20+0.1$, so that the print run does not need to be interrupted.

To facilitate the procedure described, the color density measuring system 45, 50, and a programmable or suitably programmed computer 66 are configured and assembled according to the invention as parts of a testing system which is intended for the automatic checking of the printing press for conformity with a given print specification. For this purpose the computer 66 is connected to the data storage means 54 and the control system 51 and, if desired, an additional data storage 67. Those binary values of solid color density and dot gain which were obtained in a previously completed print order which was similar to the print order now to be executed are stored on a diskette or the like. The program necessary for the performance of the above-explained computation can be entered from the data storage 54 into the computer 66 if the latter does not already contain the program in the form of a module. When the printing press is started up the solid color density/dot gain binary values that have been determined are then fed to the computer 66 under the control of the controller 51, and the computer then performs the necessary computations with these values and the data read from the data storage 67. The work station 53 is preferably provided with keyboards associated with the computer 66, by means of which the desired print specification and the tolerances associated therewith can be entered as desired in the particular case. The results of the computations of computer 66 can be displayed on the monitor 56. In the case of on-line operation, the controller 51 is preferably provided with an output 68 at which a printing press shut-down signal will appear in case the given print standard cannot be reached.

The storage of the data in the data storages 54 and 67 can be performed in many different ways. It would be possible to form a continuous curve from different solid color density/dot gain binary values and to spread it out as in FIG. 3 to a band 64 corresponding to the allowable tolerances. In this case the computer 66 needs only to find whether a binary value measured when the printing press is set up, falls within or outside of this band 64. It would furthermore be possible to store in data storage 54 the correlations obtained from previous, similar print runs, and to let the computer 66 figure whether, if one of the values of the pair is approached to the standard, also the other value would reach the associated specification. Lastly, it would also be possible to enter the necessary correlations by means of the keyboards 52, especially if the curves in FIG. 3 are straight lines and therefore the correlation is constant over the entire range concerned.

What is claimed is:

1. A method for establishing a given print specification defined by a selected solid color density/dot gain binary value in an autotype printing run which can be influenced by a plurality of printing parameters, on an autotypically operating polychrome printing press having a plurality of printing units for a multicolor printing onto a material to be imprinted, each unit having an ink box for feeding one of a plurality of printing inks onto said material and a plurality of adjustable ink adjusters for controlling feeding of said inks onto a plurality of adjacent zones of said material and thus influencing one of said printing parameters, said method comprising the steps of: starting said printing run; determining at the beginning of a set-up cycle for at least one printing ink and at least one zone, solid color densities and dot gain binary values from screen areas and solid areas printed within selected ones of said zones; testing at least one of said color density/dot gain binary values under consideration of a solid color density/dot gain correlation characteristic for the printing run for whether or not it is possible by merely changing an associated one of said adjusters to achieve said print specification; adjusting, if said printing specification can be achieved, said associated adjuster until said printing specification is achieved; and, if said printing specification can not be achieved, interrupting said printing run, changing at least one printing parameter other than the one affecting feeding of said inks so as to alter a function currently existing between the solid color density and the dot gain of said printing run, resuming said printing run, repeating said steps as often as needed until it is possible by merely changing said associated adjuster to achieve said print specification and adjusting said associated adjuster until said printing specification is achieved.

2. A method according to claim 1; and further comprising the steps of providing a preselected tolerance range for said printing specification; and changing said associated adjuster until said selected color density/dot gain binary value lies at least in said preselected tolerance range.

3. A method according to claim 1; and further comprising the step of obtaining said solid color density/dot gain correlation from a previous printing run.

4. A method according to claim 1; and further comprising the steps of measuring during said printing run solid color density/dot gain binary values; determining from said binary values a momentary solid color density/dot gain correlation; and using said momentary correlation for said testing.

5. A method according to claim 1; and further comprising the step of applying the method to all printing inks of said printing press.

6. A method according to claim 1; and further comprising the step of applying the method to all zones of said material.

7. A method according to claim 1; and further comprising the step of performing the method automatically.

8. A method according to claim 1; and further comprising the step of producing a warning signal when it is not possible to achieve said printing specification by merely changing said associated adjuster.

9. A method according to claim 8; and further comprising the step of producing said warning signal on a viewscreen of a monitor.

10. A control apparatus for establishing a given print specification defined by a selected solid density/dot gain binary value in an autotype printing run on an autotypically operating polychrome printing press having a printing form for printing onto a material to be imprinted and a plurality of printing units for a multicolor printing with said form, said printing form having sections for printing screen areas and solid areas and each printing unit having an ink box for feeding one of a plurality of printing inks and a plurality of adjusters for controlling said feeding of said one printing ink to a plurality of adjacent color zones, said control apparatus comprising: measuring means for determining data at said screen areas and solid areas and processing said data to receive said solid color density/dot gain binary values at least during a set up of the printing press; computer means for testing at least one solid color density/dot gain binary value received from said measuring means under consideration of a solid color density/dot gain correlation characteristic for the printing run for whether or not it is possible by merely changing an associated one of said adjusters to achieve said selected solid color density/dot gain binary value or a tolerance range associated thereto; and control means coupled to said measuring means and said computer means to control the transfer of said values to said computer means.

11. A control apparatus according to claim 10; and further comprising a data storage for storing solid color density/dot gain correlations characteristic of earlier similar printings, said data storage being coupled to said computer means and said control means such that said computer means makes said testing under consideration of a selected solid color density/dot gain correlation stored in said data storage.

12. A control apparatus according to claim 10; and further comprising a keyboard coupled to said control means such that said computer means makes said testing under consideration of a solid color density/dot gain correlation entered with said keyboard into said computer means.

13. A control apparatus according to claim 10, wherein said computer means is operative for making said testing under consideration of a solid color density/dot gain correlation calculated from said values.

14. A control apparatus according to claim 10; and further comprising a monitor coupled to said control means for displaying the results of the tests of said computer means.

* * * * *